US005335789A

United States Patent [19]

Taravella et al.

[11] Patent Number: 5,335,789

[45] Date of Patent: Aug. 9, 1994

[54] EDGE MOLDING FOR NESTING STACKABLE SHIPPING CONTAINERS

[75] Inventors: Philip Taravella, Grosse Pointe Shores; Edward J. Blair, New Baltimore; Ronald S. Domanski, St. Clair Shores; Joseph C. Shippell, Roseville, all of Mich.

[73] Assignee: Anchor Bay Packaging Corporation, St. Clair Shores, Mich.

[21] Appl. No.: 181,276

[22] Filed: Jan. 13, 1994

[51] Int. Cl.[5] ..... B65D 5/44; B65D 5/46

[52] U.S. Cl. ..... 206/518; 206/506; 206/519; 229/199; 229/919

[58] Field of Search ..... 229/199, 915, 919; 206/505, 506, 518, 519, 520; 220/642, 643, 758, 760, 768, 769, 772, 773

[56] References Cited

U.S. PATENT DOCUMENTS

| | | | |
|---|---|---|---|
| 411,996 | 10/1889 | Morton | 220/642 |
| 2,344,448 | 3/1944 | Oakes | 229/915 |
| 2,859,905 | 11/1958 | Choate | 206/518 |
| 3,659,774 | 5/1972 | Mielke | 279/199 |
| 3,927,812 | 12/1975 | Winters et al. | 220/760 |
| 4,316,540 | 2/1982 | Lapham | 206/518 |
| 4,529,092 | 7/1985 | Swingley, Jr. | 206/519 |
| 4,804,092 | 2/1989 | Jones | 206/518 |
| 4,863,094 | 9/1989 | Morrow et al. | 206/518 |
| 4,971,201 | 11/1990 | Sathre | 229/199 |
| 5,033,669 | 7/1991 | Federico | 229/199 |

*Primary Examiner*—Gary Elkins

*Attorney, Agent, or Firm*—Dykema Gossett

[57] ABSTRACT

An edge molding is adapted to trace the edges of a shipping container and be placed thereon. The edge molding is configured with a ledge for internesting another edge molding when said edge moldings are mounted on cartons, one carton internesting with another. The edge molding has a nesting rack pivotally mounted to be pivoted and rest outside of the perimeter of the edge molding and pivotal to mount at least a portion of the edge rack within the perimeter of the molding. In this latter position, the rack rests on the edge molding and is capable of supporting a shipping container nested above it without the carton substantially breaching the volume on which the container is nested.

11 Claims, 3 Drawing Sheets

EDGE MOLDING FOR NESTING STACKABLE SHIPPING CONTAINERS

BACKGROUND OF THE INVENTION

1. Field of the Invention

The present invention relates to shipping containers that may be stacked one upon the other and more particularly to internesting shipping containers. Still more particularly the present invention relates to an edge molding for facilitating internesting of stackable shipping containers and to preserve the edges of corrugated fiberboard or plastic containers used as such.

2. Statement of the Problem

Shipping containers used for shipping parts, agricultural products, and an assortment of other articles are often stacked one inside another so that the containers are readily available for use with minimal storage space. This is particularly so where the containers are used over and over again. Where the containers are made of corrugated plastic or thin plastic sheets, use of the containers tends to breakdown the structure of the container. Even where containers are dimensioned with lesser square footage at the bottom or floor of the container and angling upwardly to a greater square footage opening so that one container may nest within another, warping and wear of the containers will tend to cause the nesting to be uneven. Also, warping tends to cause one container to grab another container causing some difficulty in separating the containers. Still further, the edges of such containers made of the various materials tend to breakdown with excessive wear and use. While some containers may be constructed with reinforced edges, wearing through use of other parts of the container requires that the complete container be thrown out, including the reinforced parts that have experienced less tear and breakdown.

SUMMARY OF THE INVENTION

1. Objects of the Invention

It is an object of the present invention to provide a means for protecting the edges of a shipping container against breakdown and wear from use of the shipping containers.

It is another object of the present invention to provide a means for nesting shipping containers one in the other without causing breakdown of the edges of the shipping containers.

It is yet another object of the present invention to provide shipping containers with a means of internesting so that the containers may be quickly separated for use.

Yet still another object of the present invention is to provide a means for reinforcing the edges of shipping containers, while saving materials so that only reinforced parts of the shipping containers may be thrown away with wear and use and the reinforced parts may be recycled for use again and again.

2. Disclosure of the Invention

The foregoing objects of the present inventions are accomplished in an assembled shipping container in which articles may be transported. The shipping container comprises a shipping carton on which is assembled an edge molding and a bottom edge trim. The carton has end walls, side walls, and a bottom. The bottom edge trim is an angle piece that is mounted to the longitudinal edges of the shipping carton when folded where the bottom side walls and the bottom join one another.

The carton, when unassembled, is a flat piece having flaps cut as corner end flaps and middle end flap, and scoring or fold lines providing fold lines for defining the walls and the bottom of the carton and shipping container. When assembled, corner end flaps fold upon middle end flaps to define end walls.

The edge molding comprises a number of integral parts which are preferably molded into a single edge molding piece. At the upper extremity of the edge molding there is an upper extending lip. The upper extending lip extends from a ledge which projects inwardly to an inner facia. The inner facia has a return lip projecting outwardly from the inner facia (and from interior of the carton). The edge molding is one piece that extends in plan as a rectangle and that defines inner portions of the edge molding, which is within the perimeter of the rectangle and outer portions that are without the perimeter of the rectangle. Accordingly, an outer facia defines the perimeter of the rectangle. The outer facia extends from the extended lip downwardly to a foot.

Folded tabs on the carton function to hold the edge molding to the carton. Each folded tab is folded inwardly of the assembled carton to the inner facia. The edge of the folded tab is abutted against the return lip to lock the tab between the inner facia and the outer facia and between the ledge and the return lip. Accordingly, the edge molding is locked onto the carton.

Pivotally attached to the outer facia, generally adjacent the end walls, are handle and nesting racks. Apertures are provided in the outer facia to receive ends of the handle and nesting racks in the pivotal mounting. Thus, the handle and nesting racks may be pivoted to rest upon the upper extended lip, and the ledge, of the edge molding. The handle and nesting racks may be pivoted to rest outside of the edge molding, generally against the outer facia. The handle and nesting racks are bent or formed to provide a lip clearance loop, a ledge contact bend, and a carton centering bend. The handle and nesting racks are configured to roughly trace the upper lip, ledge, and inner facia of the edge molding.

The shipping containers with the edge molding in accordance with the invention may be internested, one within and upon the other. Each shipping container assembled with the edge molding and bottom edge trim is placed so that the bottom of each shipping container is within a shipping container beneath it. In such a configuration, the foot of the edge molding of a container above another container rests on the ledge of the container beneath container it. The extended lip of the below container retains the foot of the container above within the perimeter of the edge molding. This configuration efficiently stacks a number of containers one upon the other in a nesting position that will not cause the stack to be unnecessarily tall and provides for stacking a number of shipping containers in a single space.

Another nesting arrangement utilizes the handle and nesting racks. With the handle and nesting racks resting upon the upper lip and ledge of a container, another container may be set and nested upon the container beneath it; however, the container is supported upon the handle and nesting rack so that the volume of the container is not substantially breached. Thus, the container below may carry articles within it which are not set upon by a nesting container above it.

DETAILED DESCRIPTION OF THE PRESENT INVENTION

Figure 1:
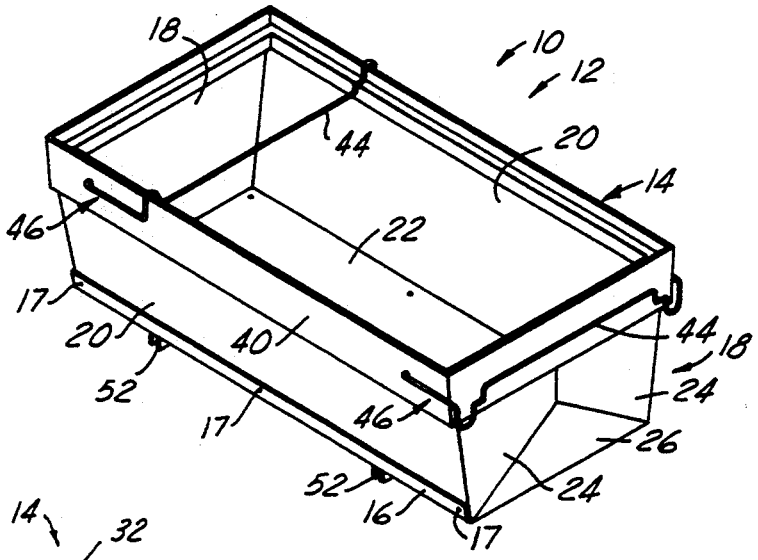
FIG. 1 is a perspective view of an assembled shipping container with the present invention incorporated thereon.

Referring to all of the figures, in which like reference numerals are continued throughout, there is seen an assembled shipping container 10 in which articles may be transported. The shipping container 10 comprises a shipping carton 12 on which is assembled an edge molding 14 and a bottom edge trim 16. The carton 12 has end walls 18, side walls 20, and a bottom 22. The bottom edge trim 16 is an angle piece that is mounted to the longitudinal edges of the shipping carton 12 when folded at the joinder of the bottom side walls 20 and the bottom 22. The bottom edge trim is mounted to the carton 12 by suitable fasteners such as rivets. Holes 17 are provided in the bottom edge trim for this purpose.

Figure 5:
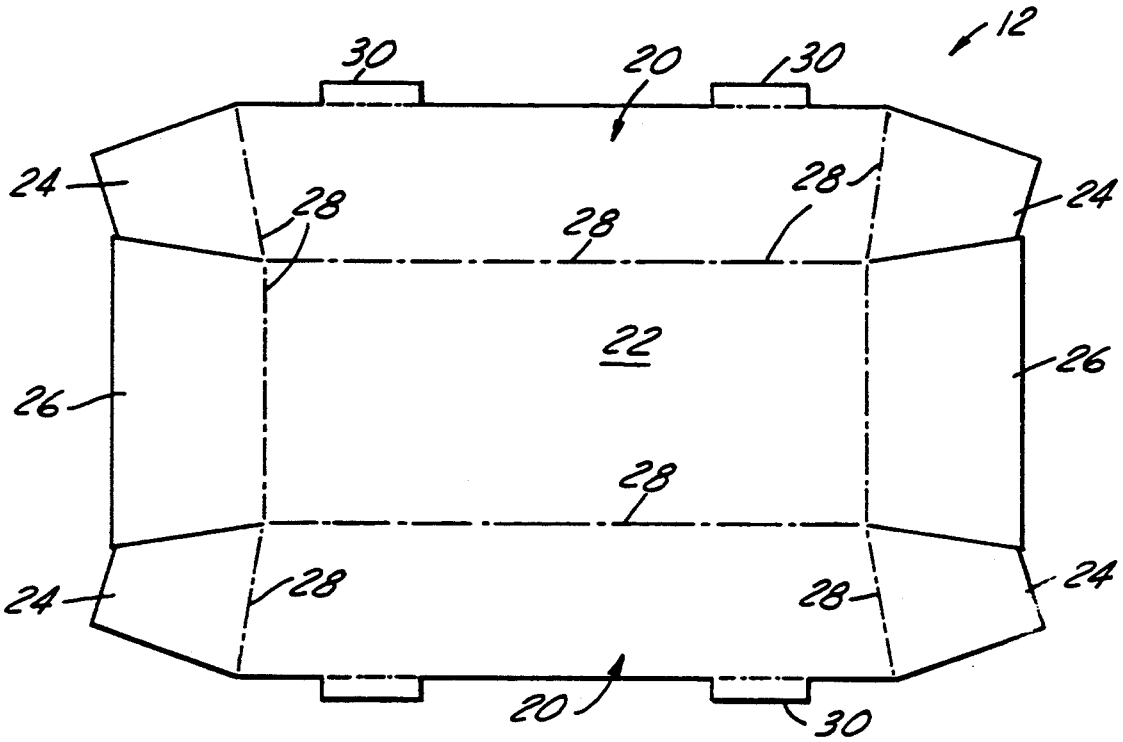
FIG. 5 is a shipping container adapted for use with the present invention, the shipping container being unassembled.

As can be seen in FIG. 5, the carton 12, when unassembled, is a flat piece having flaps cut as comer end flaps 24 and middle end flap 26, and scoring or fold lines 28 providing fold lines for defining walls 20 and bottom 22.

Figure 4:
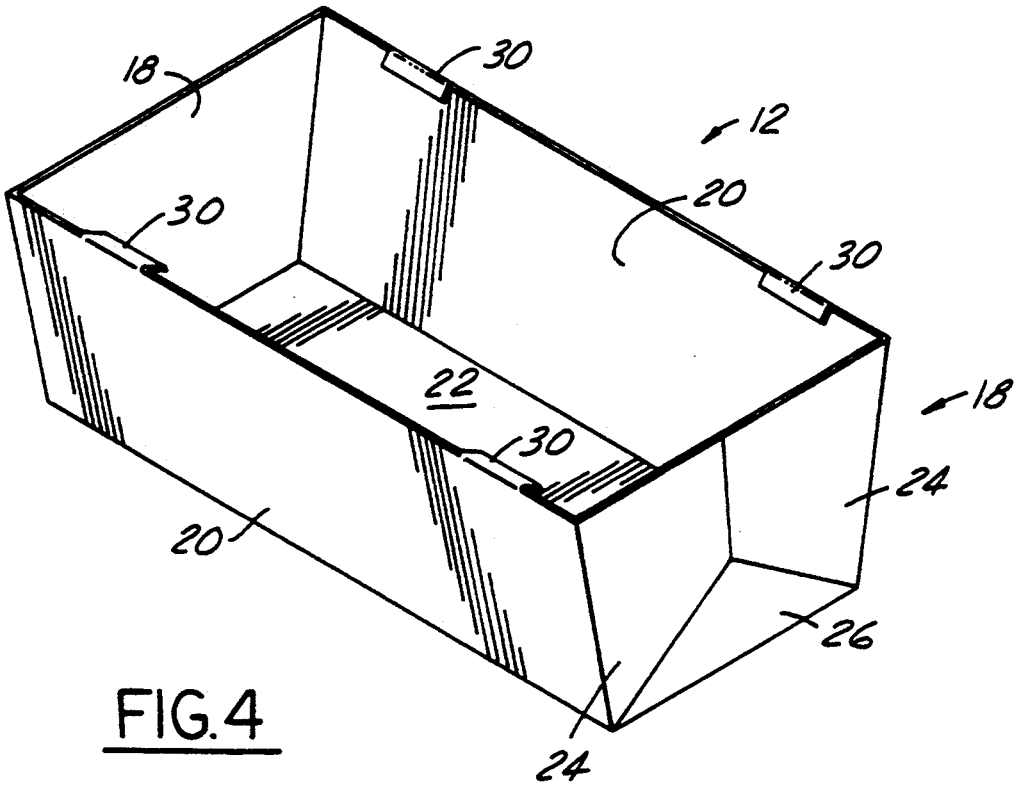
FIG. 4 is a shipping container adapted for use with the present invention, the shipping container being assembled.

When assembled, as shown in FIG. 4, comer end flaps 24 fold upon middle end flaps 26 to define end walls 18. Foldable tabs 30 extend inwardly from side walls 20. The function of foldable tabs 30 will be explained later.

Figure 2:
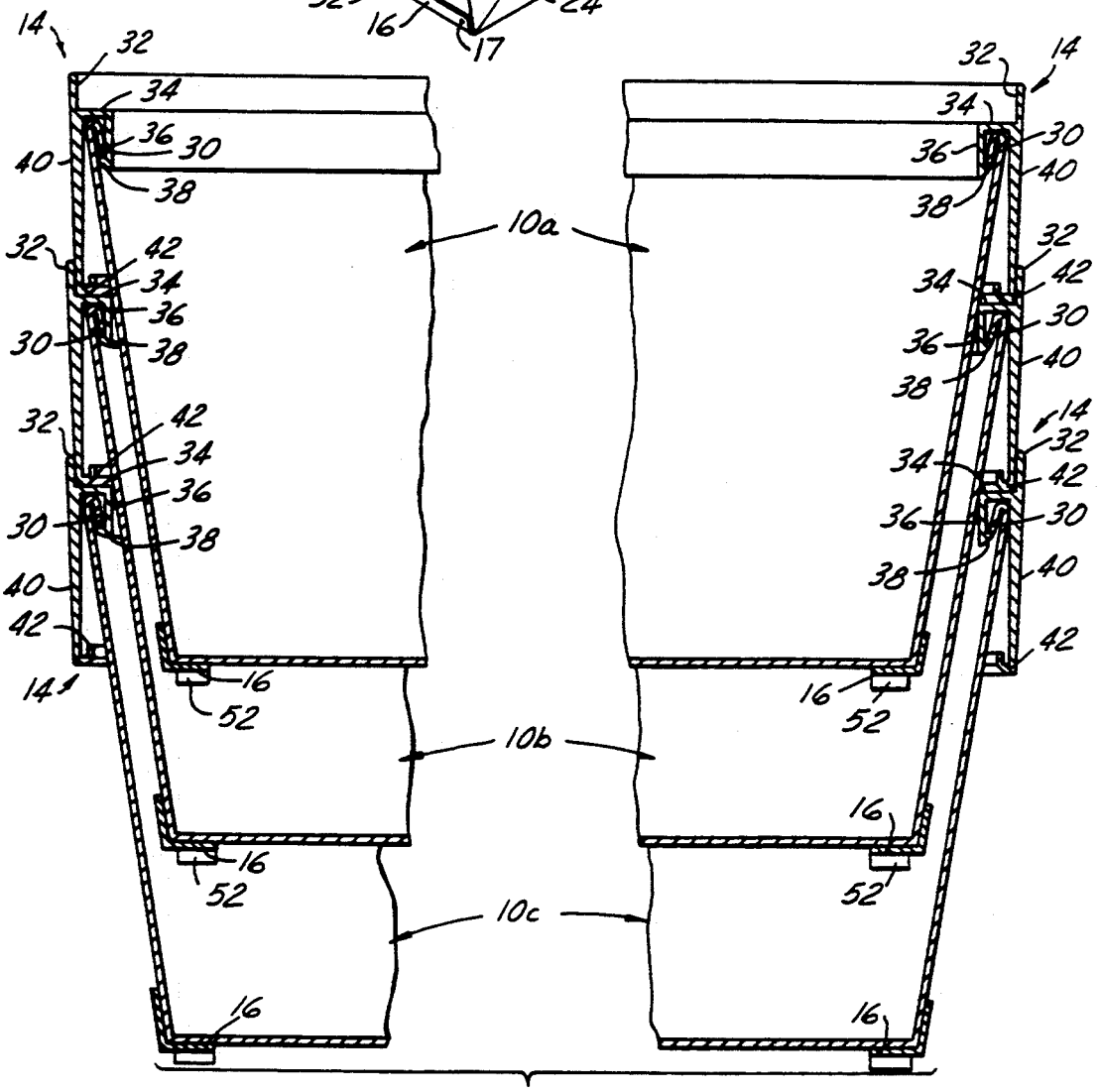
FIG. 2 is a typical section of several shipping containers internesting one within the other, in accordance with the present invention, when the shipping containers are stored relatively empty.
Figure 3:
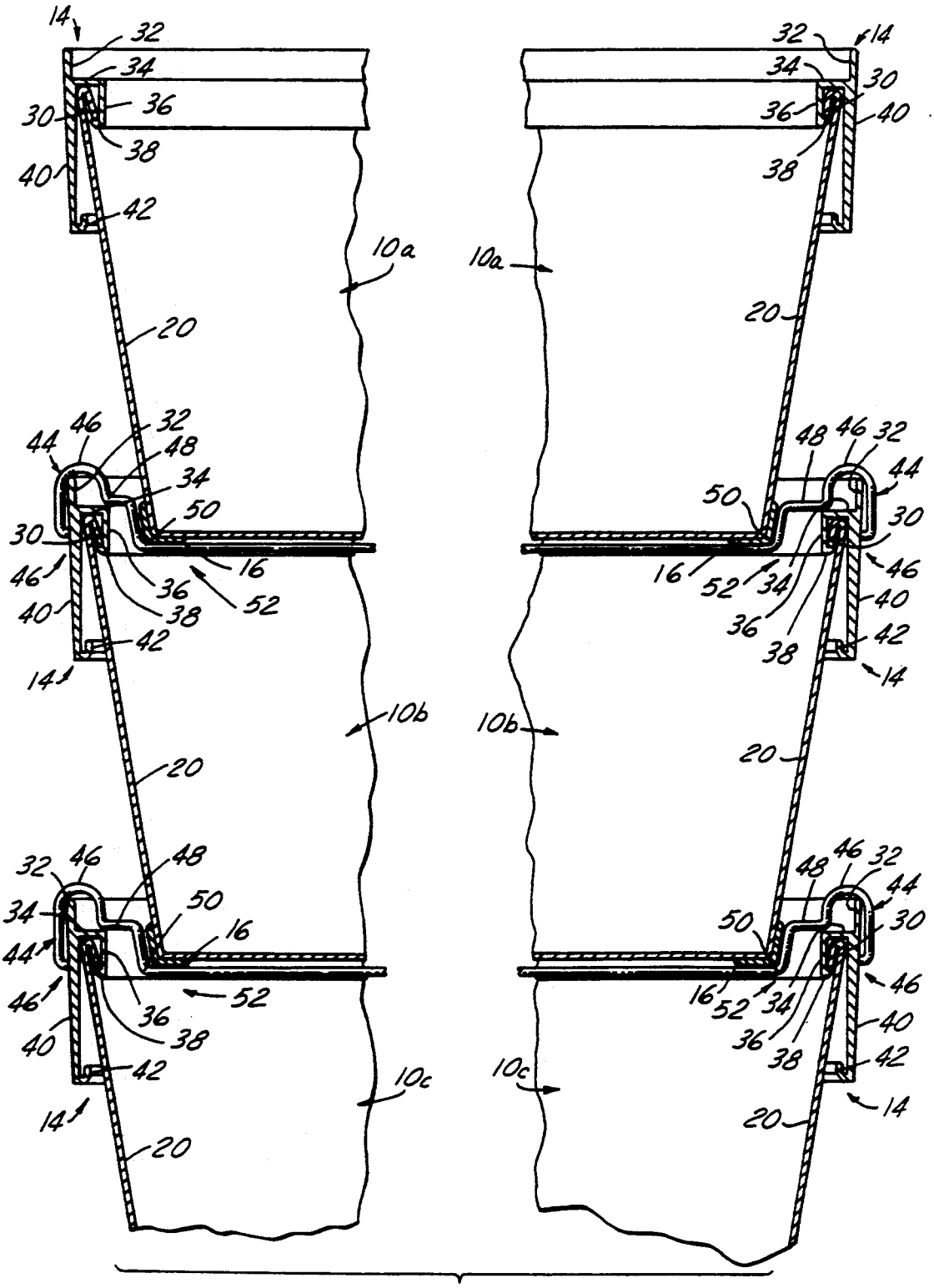
FIG. 3 is another means of internesting one shipping container upon another utilizing the present invention to allow for the contents of the internested containers from being damaged by the internesting.

The edge molding 14, as shown in FIGS. 2 and 3, comprises a number of integral parts which are preferably molded into a single edge molding piece. At the upper extremity of edge molding 14, as shown in the drawings, there is an upper extending lip 32. The upper extending lip 32 extends from a ledge 34 which projects inwardly to an inner facia 36. Inner facia 36 has a return lip 38 projecting outwardly from inner facia 36 (and from the interior of the carton 10). As can be seen in FIG. 1, the edge molding 14 is one piece extending in plan as a rectangle and defining inner portions of the edge molding 14, which is within the perimeter of the rectangle and outer portions that are without the perimeter of the rectangle. Accordingly, an outer facia 40 defines the perimeter of the rectangle. Outer facia 40 extends from the extended lip 32 downwardly to a foot 42.

The function of the folded tabs 30 of the carton 12 can now be appreciated. Folded tab 30 is folded inwardly of the assembled carton 12 to inner facia 36. The edge of folded tab 30 is abutted against the return lip 38 to lock the tab between the inner facia 36 and the outer facia 40 and between the ledge 34 and the return lip 38. Accordingly, the edge molding 14 is locked onto the carton 12.

Pivotally attached to the outer facia 40, generally adjacent the end walls 18, are handle and nesting racks 44. Apertures 46 are provided in the outer facia 40 to receive ends of the handle and nesting racks 44 in the pivotal mounting. Thus, the handle and nesting racks 44 may be pivoted to rest upon the upper extended lip 32, and the ledge 34, of edge molding 14. The handle and nesting racks 44 may be pivoted to rest outside of the edge molding, generally against the outer facia 40. The handle and nesting racks 44 are bent or formed to provide a lip clearance loop 46, a ledge contact bend 48, and a carton centering bend 50. These elements are named for their functions. It is to be appreciated that the handle and nesting racks 44 are configured to roughly trace the upper lip 32 and ledge 34 of the edge molding 14. U-shaped nesting channels 52 are provided on the edge trim 16, preferably molded thereto as an integral structure, to straddle the handle and nesting racks 44 when a plurality of shipping containers 10 are stacked one upon the other as will be latter described.

A first nesting configuration is shown in FIG. 2. Each shipping container **10*a*, 10*b*, 10*c*, assembled with edge molding 14, and bottom edge trim 16, is placed so that the bottom 22 of each shipping container 10*a*, 10*b* is within a shipping container 10*b*, 10*c* beneath the container 10*a*, 10*b*. In such a configuration, the foot 42 of the edge molding 14 of a container 10*a* above another container 10*b* rests on the ledge 34 of the container 10*b* beneath container 10*a*. The extended lip 32 of the container 10*b* retains the foot of the container 10*a* within the perimeter of the edge molding 14. Likewise, the foot 42 of the edge molding 14 of a container 10*b* above yet another container 10*c* rests on the ledge 34 of the container 10*c* beneath container 10*b*. Accordingly, the containers 10*a*, 10*b*, 10*c* are internested one within the other. As the edge molding is more rigid than the cartons 12, warping is reduced and one container 10 may be easily lifted from another or nested within the other. This configuration efficiently stacks a number of containers 10 one upon the other in a nesting position that will not cause the stack to be unnecessarily tall and provides for stacking a number of shipping containers 10** in a single space.

As can be seen in FIG. 3, another nesting arrangement utilizes the handle and nesting racks 44. With the handle and nesting racks 44 resting upon the upper lip 32 and ledge 34 of a container **10*c*, another container 10*b* may be set and nested upon the container 10*c*; however, the container 10*b* is supported upon the handle and nesting rack 44 so that the volume of the container 10*c* is not substantially breached. Thus, the container 10*c* may carry articles within it which are not set upon by a nesting container 10*b* above it. Again likewise, with the handle and nesting racks 44 resting upon the upper lip 32 and ledge 34 of a container 10*b*, another container 10*a* may be set and nested upon the container 10*a*. The container 10*b* is supported upon the handle and nesting rack 44 so that the volume of the container 10*b* is not substantially breached. Thus, the container 10*b* may carry articles within it which are not set upon by a nesting container 10*a* above it. The nesting channels 52 stabilize the stacked containers 10*a*, 10*b*, 10*c* and keep them from shifting toward the end walls 18**.

It is contemplated that the edge molding 14 of the present invention requires no fasteners when assembled upon the cartons 12. Moreover, the molding 14 may be extruded and molded as a single piece. When a carton 12 is damaged or soiled to the extent that it can no longer be used, it is clear that the edge molding may be taken off that carton 12 and used on another. It is also contemplated that the plastic molding may work with plastic sheet cartons, corrugated plastic cartons, or corrugated or fiberboard cartons.

It should be understood that any embodiment of the invention that has been described in detail may be subjected to modifications and other embodiments incorporating the inventive features. Accordingly, it is intended that the foregoing disclosure is to be considered as illustrating the principals of the present invention as an example of those features and not as a delimiting description, which is the purpose of the claims that follow.

We claim:

1. An edge molding for a first stackable shipping container having an open top, a closed bottom, and walls defining an inner volume between said open top and said bottom, the molding comprising:

perimeter defining means for defining the perimeter of said open top when said edge molding is mounted on said first stackable shipping container and for restraining a second shipping container within said perimeter defining means when an edge molding is placed on said another shipping container;

resting means within said perimeter defining means for resting said second shipping container upon said resting means when an edge molding is placed on said second shipping container;

bearing means for bearing on the resting means of a third shipping container having an edge molding mounted thereon; and mounting means for mounting said edge molding to said first stackable shipping container.

2. The edge molding as claimed in claim 1, wherein said first stackable shipping container has foldable tabs extending from at least two opposing walls of said walls and wherein said mounting means cooperates with said foldable tabs to hold said molding on said first stackable container.

3. The edge molding as claimed in claim 2, wherein said perimeter defining means includes an outer facia defining the perimeter of the edge molding and an extended lip extending upwardly from said outer facia, said lip having an inner surface within said perimeter.

4. The edge molding as claimed in claim 3, wherein said resting means is a ledge extending generally orthogonally from said extended lip.

5. The edge molding as claimed in claim 4, wherein said bearing means is a ledge extending generally orthogonally from said extended lip.

6. The edge molding as claimed in claim 5, wherein said bearing means is a foot ledge extending inwardly from an edge of said outer facia, said outer facia extending between said foot and said upper lip, whereby when said edge molding is mounted on said first shipping container, said foot ledge of said first shipping container may rest on the ledge of an edge molding mounted on said third shipping container to nest said first shipping container within said third shipping container.

7. The edge molding as claimed in claim 6, wherein said mounting means is an inner facia extending from said ledge, said ledge extending between said inner facia and said lip, said inner facia including a return lip extending outwardly toward the perimeter of said molding from said inner facia, and wherein said mounting means is for cooperating with said folded tabs, said tabs being folded to abut against said return lip to lock said tab between said inner facia and said outer facia and between said ledge and said return lip.

8. The edge molding as claimed in claim 7, further comprising pivotable handle and nesting means for lifting and carrying said first stackable shipping container when said edge molding is mounted thereon and for nesting said second shipping container upon said handle and nesting means.

9. The edge molding as claimed in claim 8, wherein said pivotable handle and nesting means includes handle and nesting racks, said handle and nesting racks being pivotal upon the upper lip and ledge of said first shipping container so that said second container may be set and nested upon said handle and nesting racks and be supported thereupon so that the volume of the container is not substantially breached.

10. An edge molding for stackable shipping containers, the molding comprising:

an outer facia defining the perimeter of the edge molding;

an extended lip extending from said edge molding, said lip having an inner surface within said perimeter;

a ledge extending generally orthogonally from said extended lip;

an inner facia extending from said ledge, said ledge extending between said inner facia and said lip, said inner facia having a return lip extending outwardly toward the perimeter of said molding from said inner facia; and a foot ledge extending inwardly from an edge of said outer facia, said outer facia extending between said foot and said upper lip, whereby when said edge molding is placed upon an edge tracing the perimeter of a carton, the foot ledge of another carton may rest on the ledge of said edge molding to nest one carton within the other.

11. The edge molding as claimed in claim 10, wherein a resting rack is pivotally mounted in said edge molding, said rack being pivotal from a position outside the perimeter of said edge molding to a position wherein at least a portion of said rack is within said edge molding to provide a nesting rack for a shipping container placed upon said rack.

* * * * *